US005088729A

United States Patent [19]

Dalebout

[11] Patent Number: 5,088,729

[45] Date of Patent: Feb. 18, 1992

[54] TREADMILL FRAME AND ROLLER BRACKET ASSEMBLY

[75] Inventor: William T. Dalebout, Logan, Utah

[73] Assignee: Weslo, Inc., Logan, Utah

[21] Appl. No.: 479,835

[22] Filed: Feb. 14, 1990

[51] Int. Cl.[5] ..... A63B 23/06

[52] U.S. Cl. ..... 272/69

[58] Field of Search ..... 272/69, 70, 97

[56] References Cited

U.S. PATENT DOCUMENTS

| | | | |
|---|---|---|---|
| 3,731,917 | 5/1973 | Townsend | 272/69 |
| 4,077,626 | 3/1978 | Newman . | |
| 4,374,587 | 2/1983 | Ogden | 272/69 |
| 4,423,864 | 1/1984 | Wilk | 272/69 X |
| 4,591,147 | 5/1986 | Smith et al. | 272/69 |
| 4,616,822 | 10/1986 | Trulaske et al. | 272/69 |
| 4,729,558 | 3/1988 | Kuo | 272/69 |
| 4,736,944 | 4/1988 | Johnson et al. . | |
| 4,886,266 | 12/1989 | Trulaske | 272/69 |

FOREIGN PATENT DOCUMENTS 196877 10/1986 European Pat. Off. ..... 272/69

*Primary Examiner*—Robert Bahr

*Attorney, Agent, or Firm*—Trask, Britt & Rossa

[57] ABSTRACT

A motorized treadmill has a right roller bracket and a left roller bracket with a tail roller interconnected thereinbetween. The brackets mate into the left extension and the right extension respectively of the treadmill frame. The treadmill frame is unitarily formed and is "U" shaped. The left and right roller bracket together with the tail roller secure the rear ends of the left and right extensions together and hold them in a spaced apart condition. in addition, belt guides are positioned to guide the lower stretch of the endless belt. The belt guides extend upwardly and inwardly and forwardly at preselected angles to minimize belt wear and belt noise in operation.

1 Claim, 5 Drawing Sheets

TREADMILL FRAME AND ROLLER BRACKET ASSEMBLY

BACKGROUND OF THE INVENTION

1. Field

This invention relates to exercise treadmills, and in particular to treadmills having a frame with a rear roller assembly and an endless belt.

2. State of the Art

Typical treadmills include a continuous or endless belt trained about a pair of rollers. The belt has an upper stretch which extends over a tread base which supports a user thereon. The base is secured to a frame which generally consists of a box frame formed of two longitudinal members and two cross-members or braces secured to the longitudinal members proximate the front end and the rear end of the machine. The rollers are attached to and between the longitudinal frame members. A front roller may be driven by a motor. Typically, the user may change the speed of the continuous belt to increase the rate at which the exerciser must walk or run in order to maintain relative position on the treadmill. Typical treadmills as above described are relatively expensive to manufacture. The frame is made of durable material with the cross-members welded thereto. A less expensive but equally durable structure is desirable.

SUMMARY OF THE INVENTION

A treadmill has a frame with a left and a right extension. The extensions are spaced apart from each other and are in substantial alignment. The left and right extensions together with a transverse member are assembled to be in a "U" shape. A tread base is attached to the frame to extend between the left extension and the right extension to support a user exercising thereon. A drive roller is rotatably secured to and between the left extension and the right extension between the tread base and transverse member of the frame. Drive means is secured to the frame and connected to the drive roller to rotate the drive roller. A left roller bracket and a right roller bracket are each secured to their respective left and right extensions proximate the rear ends thereof. A tail roller is rotatably adapted to the left roller bracket and the right roller bracket to extend thereinbetween in transverse alignment with the drive roller to space the left extension from the right extension and to secure the left extension to the right extension. An endless belt is trained about the drive roller and the tail roller and is driven by the drive roller. The endless belt has an upper stretch extending over the tread base to support a user thereon.

Preferably, the left roller bracket has a left connector formed to mate with the distal end of the left extension. The right roller bracket preferably has a right connector formed to mate with the distal end of the right extension. The left roller bracket desirably has a left journal housing oriented toward the right roller bracket when it is secured to the left extension. Similarly, the right roller bracket has a right journal housing oriented toward the left roller bracket when the right roller bracket is secured to the right extension. The tail roller is adapted to and between the left journal housing and the right journal housing.

In a preferred arrangement, the left roller bracket includes left adjustment means to adjust the transverse alignment of the tail roller with respect to the drive roller. Similarly, the right roller bracket preferably includes right adjustment means to adjust the transverse alignment of the tail roller with respect to the drive roller. In a desired configuration, the tail roller includes a left shaft extending outwardly therefrom. The left journal housing includes a left shaft slot to receive the left shaft. The left adjustment means includes a left adjustment member extending from the left shaft slot to exterior the left roller bracket for operation by the user to move the left shaft within the left shaft slot. Preferably, the left adjustment member includes bolt means threadedly associated with the left shaft to urge the left shaft outwardly from the rear end of the left extension.

In yet another preferred embodiment, the tail roller includes a right shaft extending outwardly therefrom. The right journal housing includes a right shaft slot to receive the right shaft therein. The right adjustment means includes an adjustment member extending from the right shaft slot to exterior the right roller bracket for operation by the user to move the right shaft within the shaft slot. The right adjustment is preferably bolt means threadedly associated with the right shaft to urge the right shaft outwardly from the rear end of the right extension.

In an alternate arrangement, the left extension and the right extension are tubular. The left connector and the right connector are preferably each sized to snugly fit within the distal ends of the left extension and the right extension respectively. Desirably, the left extension and the right extension are each rectilinear in cross-section.

In an alternate embodiment, the endless belt includes a lower stretch extending between the drive roller and the tail roller under the tread base. The lower stretch has a left edge and a right edge. The treadmill includes a left belt guide secured to the left extension to contact the left edge and a right belt guide secured to the right extension. The left belt guide has a finger which extends upwardly toward the tread base forwardly the drive roller and inwardly toward the right extension to contact the right edge. The left belt guide also has a transverse section secured at one end to the left end with the finger secured to the other end thereof.

In another configuration, the right belt guide includes a transverse section secured to the right extension to extend toward the left extension and a finger secured to the distal end of the transverse member. The finger extends upwardly toward the tread base, forwardly toward the drive roller and inwardly to contact the right edge.

In a preferred arrangement, the left finger and the right finger each extend inwardly at an angle from about 10 degrees to about 30 degrees with respect to the left and right extensions respectively and most preferably at an angle of about 20 degrees. The left finger and the right finger each extend upwardly at an angle from about 40 degrees to about 70 degrees and preferably about 66 degrees with respect to the transverse section of the left and right belt guides. It is also preferred that the left finger and the right finger each extend forwardly at an angle from about 10 degrees to about 40 degrees with respect to the left and right extensions respectively and most preferably at an angle of about 30 degrees.

In a highly preferred arrangement, the frame is unitarily formed with the left extension and the right extension extending from their respective front ends to their respective rear ends without interconnecting supports secured thereinbetween. The frame is desirably formed of tubing rectilinear in cross-section.

BRIEF DESCRIPTION OF THE DRAWINGS

In the drawings, which illustrate what is presently regarded as the best mode for carrying out the invention.

DETAILED DESCRIPTION OF THE ILLUSTRATED EMBODIMENT

Figure 1:
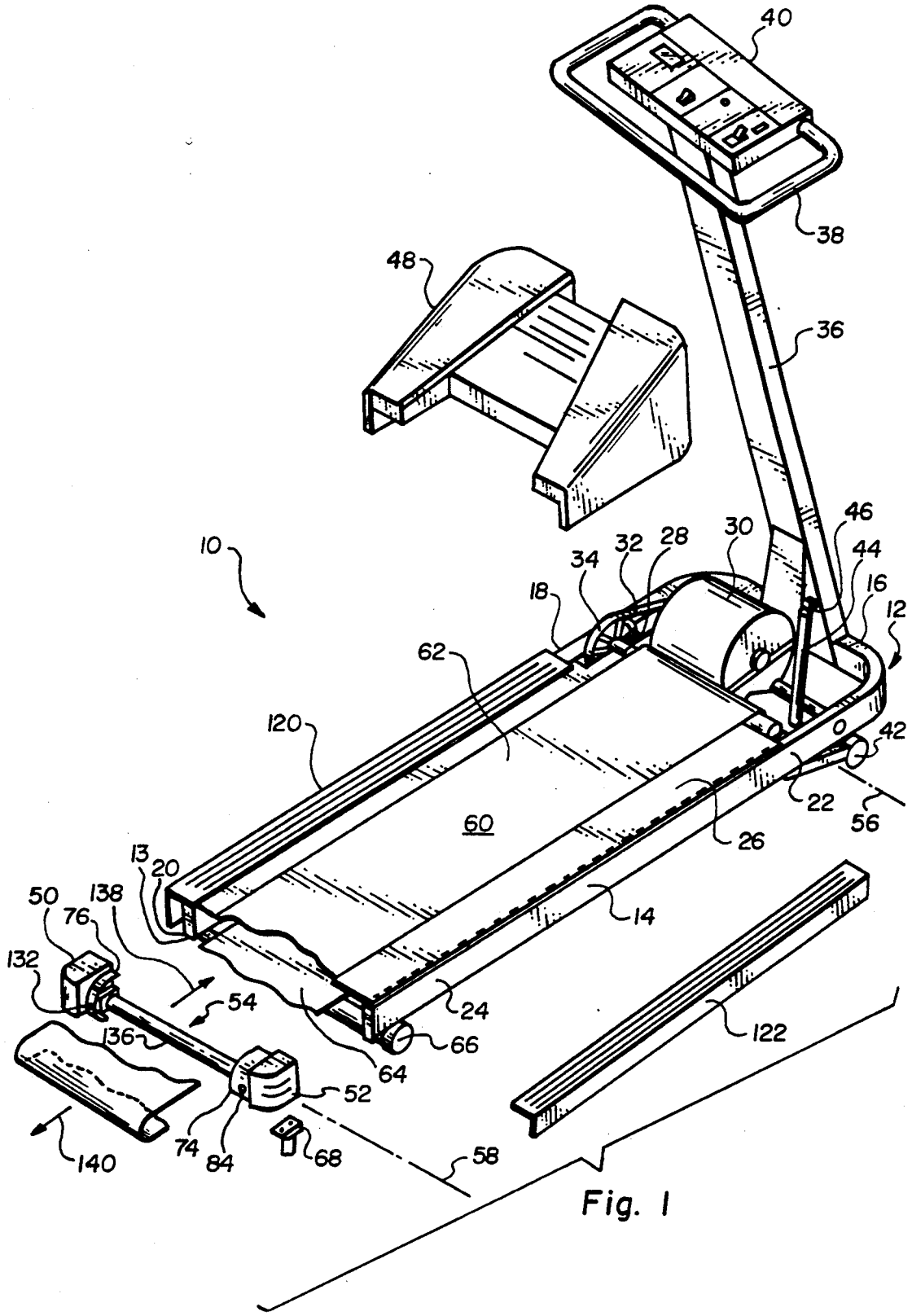
FIG. 1 is a perspective view of the treadmill of the instant invention.

The treadmill of FIG. 1 is generally denominated by the number 10. It has a frame 12 which includes a left extension 13 and a right extension 14. The left and right extensions are each spaced apart from the other and in substantial alignment as illustrated. A transverse member 16 is interconnected between the left extension 13 and the right extension 14 to form a "U"-shaped frame. The left extension 13 has a front end 18 and a rear end 20. Similarly, the right extension 14 has a front end 22 and a rear end 24. A tread base 26 is attached to the frame 12 to extend between the left extension 13 and the right extension 14 to support an exercising user thereon. A drive roller 28 is adhered to and inbetween the left extension 13 and the right extension 14 between the tread base 26 and the transverse member 16. As can be seen, the drive roller 28 is positioned immediately forward of the tread base 26.

Treadmill 10 includes drive means which is secured to the frame 12 and connected to rotate the drive roller 28. The drive means illustrated in FIG. 1 includes a motor 30 interconnected by a pulley belt 32 to a pulley 34 secured to the drive roller 28. Means may be provided to vary the speed of the pulley belt 32 by selecting a motor 30 which is a variable speed DC motor or by providing structure to mechanically vary the speed of the pulley belt 32.

The treadmill 10 of FIG. 1 also includes an upstanding post 36 with a handle 38 and console 40 connected thereto. The treadmill 10 also includes forward wheel structure 42 which is interconnected to a cylinder 44. The cylinder 44 is connected to a bracket 46. The cylinder 44 is operable by a lever in the console 40 to urge the wheel structure 42 toward and away from the frame 12 to in turn adjust the angle of inclination of the treadmill 10. As known, by adjusting the angle of inclination, the user may adjust the degree of difficulty of the exercises being performed on the treadmill 10.

In FIG. 1, a housing 48 is shown in an exploded relationship with respect to the frame 12. More particularly, the housing 48 is configured to be positioned over the motor 30, cylinder 44 and the associated structure positioned forward of the tread base 26 to prevent accidental contact with moving parts and to minimize the number of surfaces and apertures into which a user might step or slip during use.

The treadmill 10 of FIG. 1 has a left roller bracket or end cap 50 and right roller bracket or end cap 52 which are secured to their respective left extension 13 and right extension 14 proximate the rear ends 20 and 24, respectively. A tail roller 54 is adapted to and between the left roller bracket 50 and the right roller bracket 52 in transverse alignment with the drive roller 28. To be in transverse alignment, the axis 56 of the drive roller 28 is substantially parallel to the axis 58 of the tail roller 54. The tail roller 54 spaces the left extension 13 from the right extension 14 and secures the left extension to the right extension 14. That is, the tail roller 54 along with the left roller bracket 50 and right roller bracket 52 also act as a transverse member to form the frame.

As may be further observed in FIG. 1, the treadmill 10 also includes an endless belt 60 which is trained about the drive roller 28 and the tail roller 54 over the top of the tread base 26. The user may walk, jog or run on the endless belt 60 and thereby exercise with the weight of the user being supported by the tread base 26. The endless belt 60 has an upper stretch 62 which is positioned on top of the tread base 26 and a lower stretch 64 which extends between the drive roller 28 and tail roller 54 under tread base 26. A rear foot 66 may be provided proximate the rear end 20 of the left extension 13 and the rear end 24 of the right extension 14 to support the frame 12 upon a surface. Alternately, a support foot 68 may be bolted to or unitarily formed to be part of the right roller bracket 52 and a similar foot bolted to or formed to be part of the left roller bracket 50 to support the frame 12 and in turn the treadmill 10 on a support surface selected by the user.

Figure 2:
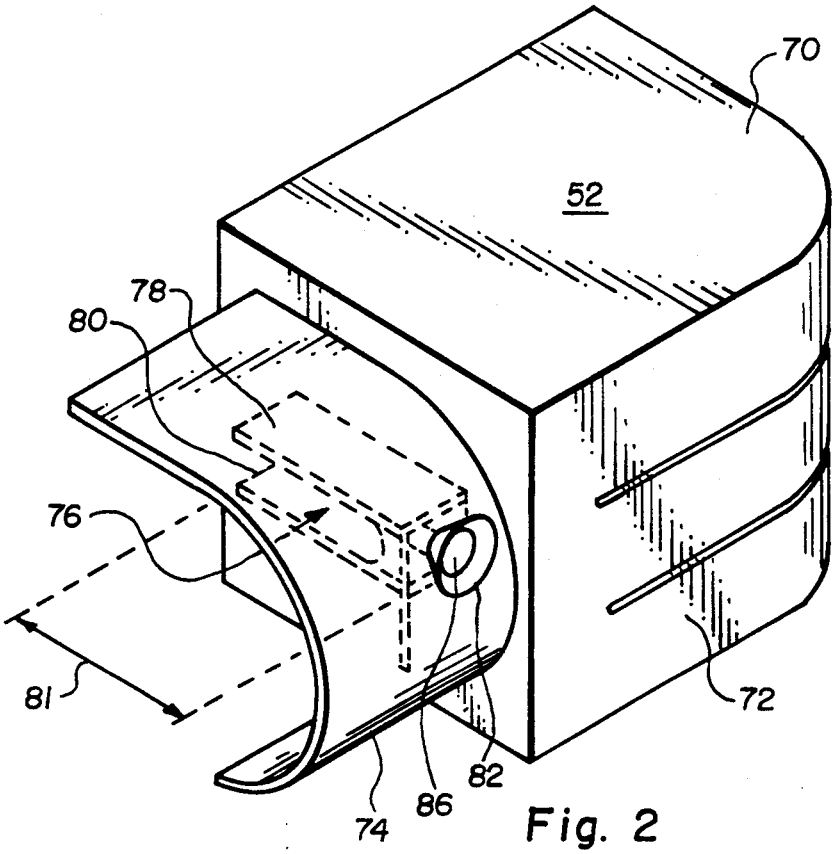
FIG. 2 is a perspective view of the right roller bracket for use with the treadmill of FIG. 1.
Figure 4:
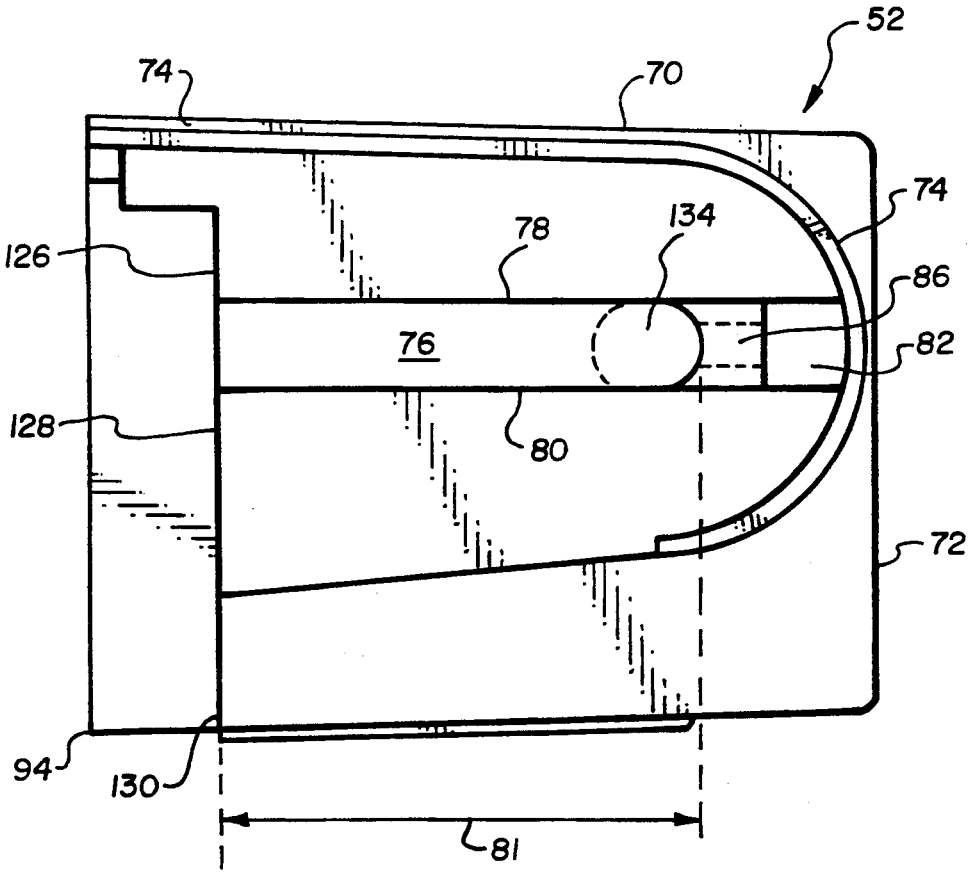
FIG. 4 is a side view of the right roller bracket shown in FIGS. 2 and 3.

Referring to FIG. 2, the right roller bracket 52 is shown in perspective to have a top surface 70 and a rear surface 72. The right roller bracket 52 has a right, journal housing 74 which is oriented toward the left roller bracket 50 when secured to the right extension 14. The left roller bracket 50 has a similar roller bracket housing 76 which is oriented toward the right roller bracket 52 when the left roller bracket 50 is mated to the left extension 13. The tail roller 54 is adapted to and between the left journal housing and the right journal housing 74. Both the left and the right roller brackets 50 and 52 include adjustment means to adjust the transverse alignment of the tail roller 54 with respect to the drive roller 28.

As specifically shown in FIGS. 2 through 5, the right roller bracket 52 and more particularly the right journal housing 74, includes a right shaft slot 76. The tail roller 54 includes a right shaft 78 which extends outwardly therefrom and which is sized to snugly fit within the slot 76. The slot 76 is formed by an upper slot member 78 and a lower slot member 80 and is sized in length 82 to provide sufficient distance to facilitate assembly of the treadmill 10 and to provide for adjustment of the tail roller 54, as more fully discussed hereinafter.

As shown in FIG. 2, the right journal housing has an recess 82 which is formed therein substantially in alignment with the slot 76. A bolt 84 is positioned through the bolt aperture 86 in the recess 82 to connect with the right shaft 78. The right shaft 78 has an aperture 88 formed therein with threads to threadedly receive the bolt 84. Thus the shaft 78 may be moved along the length 81 of the slot 76 either toward or away from the rear end 24 of the right extension 14 by operation of the bolt 84. As can be seen, the bolt is shown with a slot 90 to receive a screw driver. The bolt 90 may also be configured to receive an allen wrench or any other mechanical device for operating a bolt.

Figure 3:
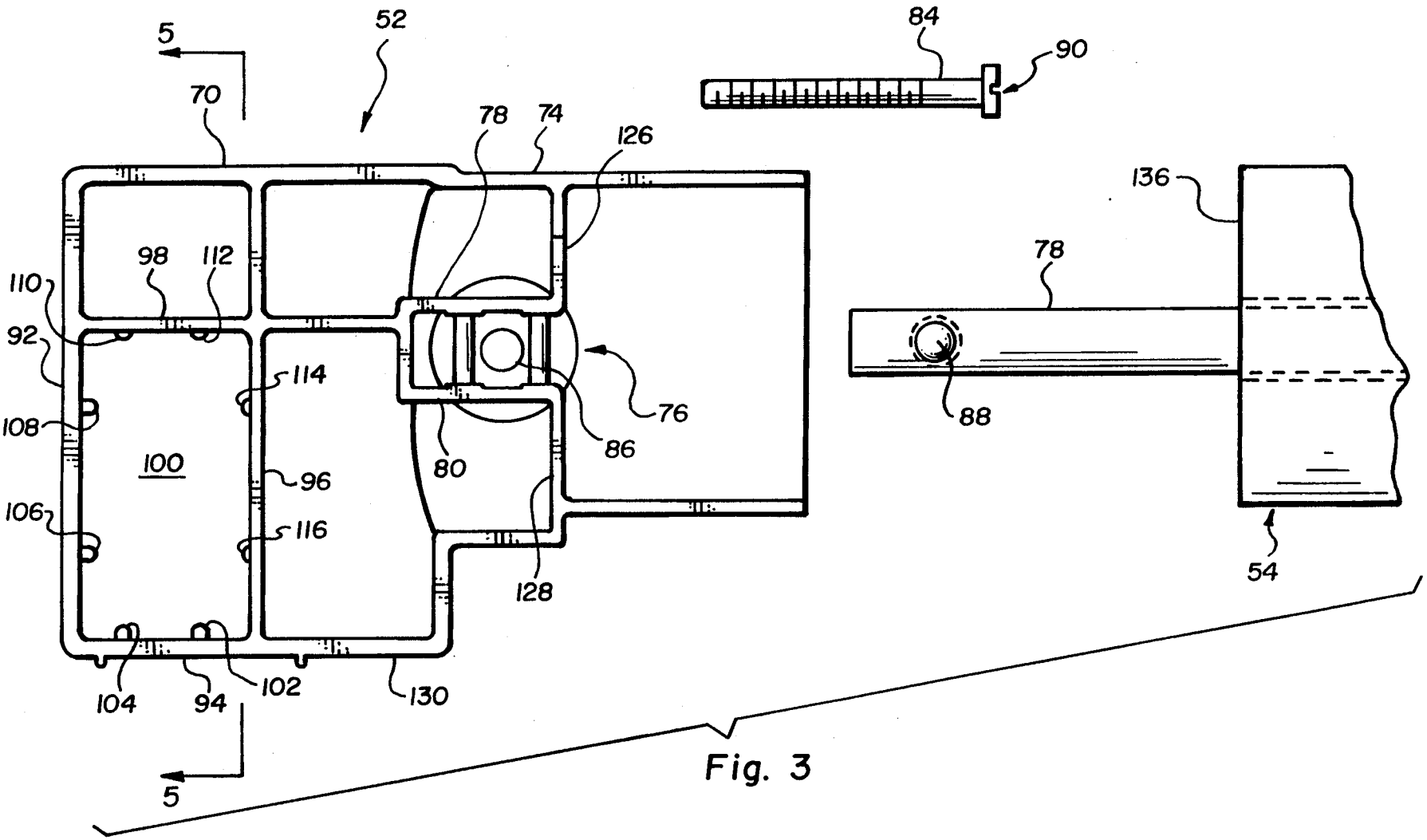
FIG. 3 is a rear view of the right roller bracket of FIG. 2 with a tail roller spaced therefrom.

The right end cap 52 has an outside member 92 which together with a base member 94 and internal structural members 96 and 98 form a rectilinear cavity 100 as best seen in FIG. 3. Within the rectilinear cavity 100 are a plurality of friction beads 102, 104, 106, 108, 110, 112, 114, and 116. The cavity 100 is sized with the friction beads 102 through 116 to snugly receive the rear end 24 of the right extension 14. The friction beads 102 through 116 provide for a snug frictional mating and constitute a right connector for connecting the right roller bracket 52 to the rear end 24 of the right extension 14. The right connector may also include a screw 118 to fasten the right roller bracket 52 to the rear end 24 of the right extension 14. The left roller bracket 50 is similarly configured to have a left connector.

In FIG. 1, a left safety step 120 is secured to the left extension 13 to extend substantially along the length of the left extension 13 as best seen in FIG. 1. A similar safety step 122 is positionable on the right extension 14 but is here shown spaced therefrom for clarity of illustration.

Figure 5:
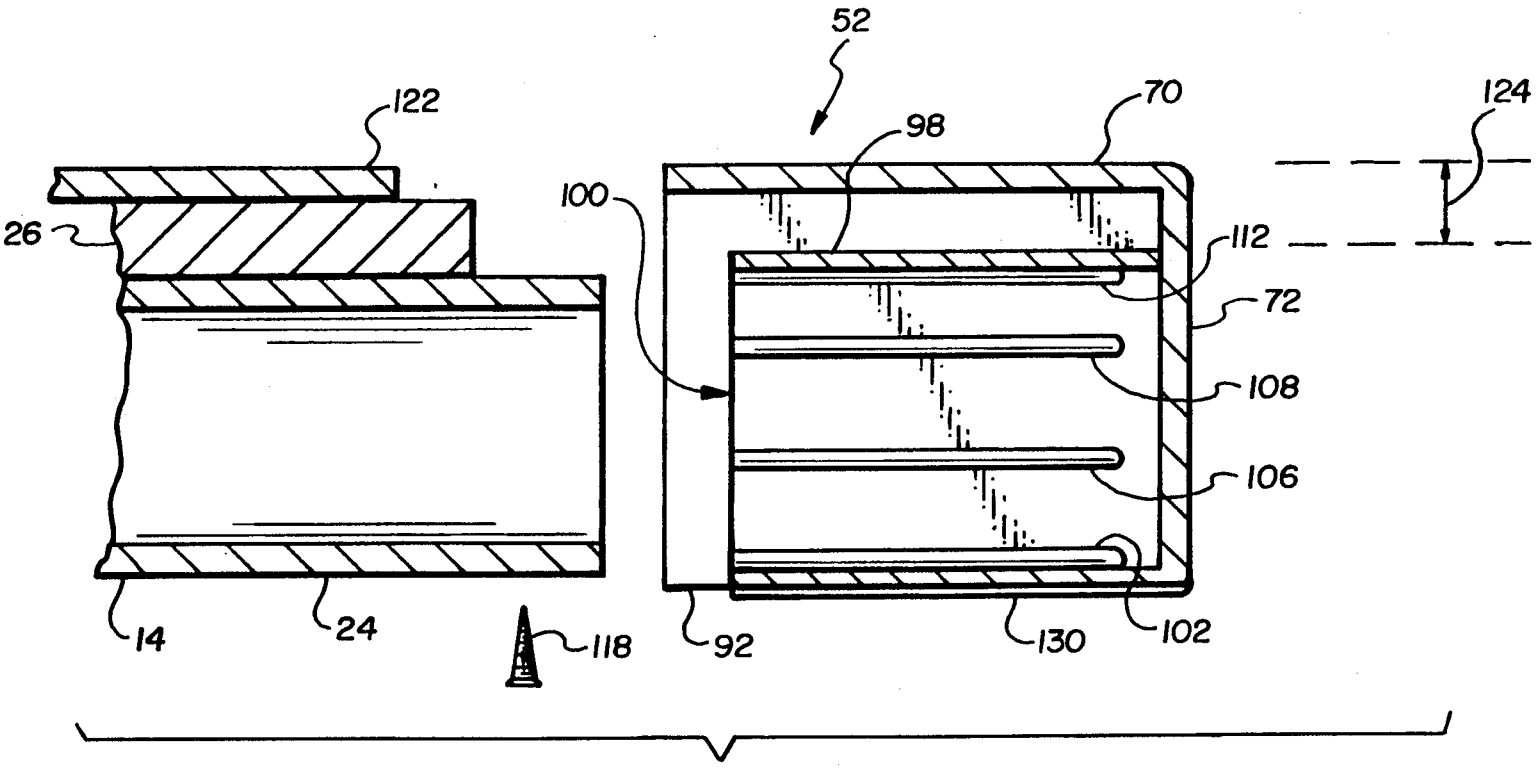
FIG. 5 shows a right roller bracket and the rear end of the right extension in cross-section.

In FIG. 5, the right safety step 122 is shown secured to the right extension 14 with the tread base 26 connected thereinbetween. It can be seen that the right roller bracket and the interior upper surface 98 are spaced apart a preselected distance 124 so that the surface 70 of the right roller bracket 52 is substantially in alignment with the right safety step 122 when the right roller bracket 52 is mated with the end 24 of the right extension 14. In such a fashion, a relatively secure, smooth fit can be effected along with a smooth exterior surface. In use, the user may stand with one foot on the safety step 120 and one foot on the safety step 122 straddling the upper stretch 62 of the endless belt 60. The user may then operate the belt and cause it to move and step onto the endless belt 60 from the safety steps 120 and 122 or from the endless moving belt 60 onto the safety steps 120 and 122 as circumstances require.

Referring back to FIG. 3, the slot 76 is formed of an upper member 78 and a lower member 80. The upper member 78 is integrally formed with a vertical extension 126. The lower member 80 is connected to vertical member 128 which in turn is connected to horizontal member 129 and upright member 127. The members 126, 127, 128 and 129 together provide rigidity by interconnection to the upper surface 70 and to the lower surface 130 of the right roller bracket 52.

It may be noted that FIGS. 2 through 5 illustrate the right roller bracket 52 as shown in FIG. 1. The left roller bracket 50 of FIG. 1 is substantially identical to the right roller brackets 52 illustrated and described with respect to FIGS. 2 through 5 except that it is configured to be left handed or the mirror image of the right roller bracket 52. Notably, both the left roller bracket 50 and the right roller bracket 52 are shown with a left journal housing 76 and a right journal housing 74 that have an adjustment means and more particularly a adjustment member such as a bolt 84 for adjusting the transverse alignment of the tail roller 54 with respect to the drive roller 28. The bolt 132 associated with the left roller bracket 50 is operable in the same manner as the bolt 84 associated with the right roller bracket 52. It may be noted that an adjustment means may be provided only for one of the two roller brackets 50 and 52. The roller bracket which does not have an adjustment means may be formed to have a simple journal bearing 134 to receive the shaft of the tail roller 54 and to retain the shaft in position with in the selected roller bracket.

As best seen in FIG. 3, the tail roller 54 has a right shaft 78 extending outwardly therefrom. The tail roller 54 has a pulley member 136 rotatably secured about the shaft 78. The right shaft 78 extends into and preferably through the pulley structure 136 to extend outwardly from the pulley structure on the left end to form a left shaft similar to the right shaft 78.

In operation, the left shaft as well as the right shaft 78 are inserted into their respective left and right shaft slots such as the right shaft slot 76. The respective bolts such as bolts 84 and 132 are threadedly interconnected with the aperture 88 on the right side and a similar aperture on the left shaft (not shown).

The tail roller 54, and more particularly the pulley 136, is positioned between the upper stretch 62 and the lower stretch 64 (FIG. 1). The associated brackets 50 and 52 are positioned to mate with the rear end 24 of the right extension 14 and the rear end 20 of the left extension 13. The endless belt 60 urges the pulley 136 towards 138 the extensions 13 and 14. The bolts 84 and 132 are operated to draw the tail roller 54 outwardly 140 away form the rear end 20 and 24 to in turn snugly secure the belt 60 over the tread base 26. Appropriate operation of the bolts 84 and 132 also facilitates alignment and in turn the retention of the belt 60 centrally on the pulley 136. That is, slight transverse misalignment allows the endless belt 60 to walk towards the left or to the right extensions 13 and 14. Appropriate adjustment of the bolts 132 and 84 may be used to reduce the tendency of the belt to walk along the pulley 136.

Figure 8:
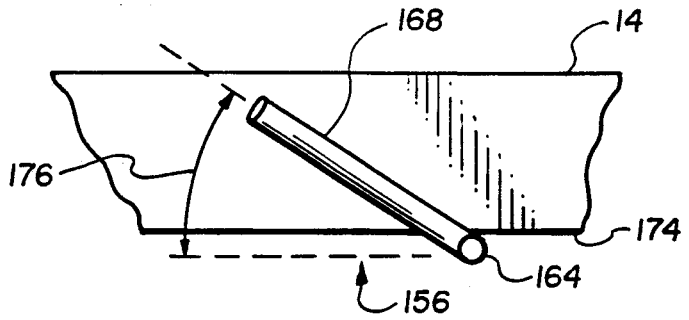
FIG. 8 is a partial view of the right extension of the "U"-shaped frame of FIG. 6.
Figure 7:
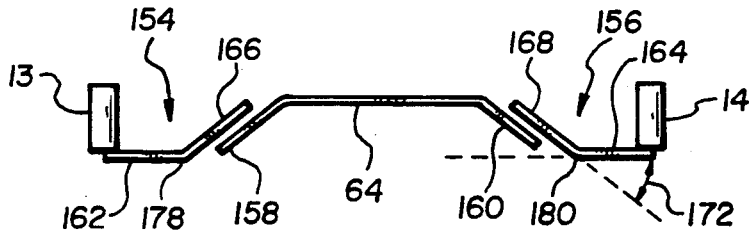
FIG. 7 is a simplified cross-sectional view of the "U"-shaped member of FIG. 6.
Figure 6:
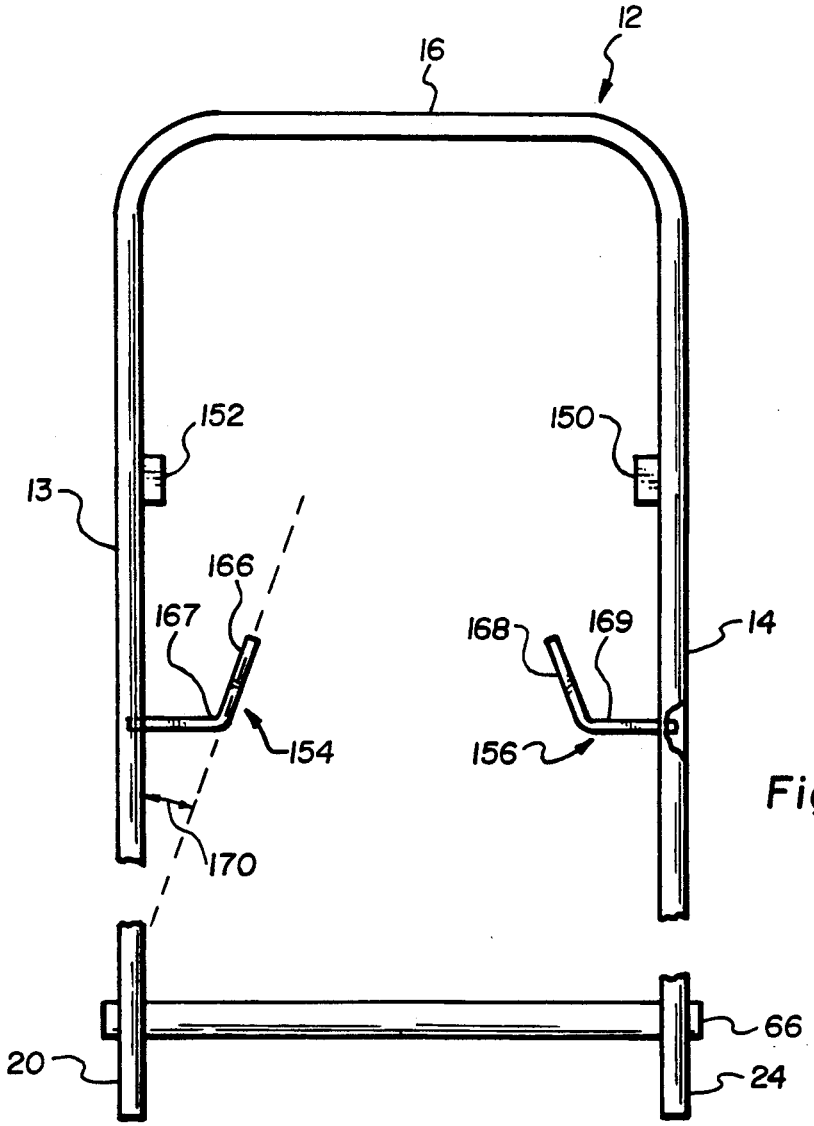
FIG. 6 is a simplified top view of a "U"-shaped frame of the instant invention.

Referring now to FIGS. 6, 7 and 8, the left extension 13 and the right extension 14 are shown interconnected with the transverse member 16 to form a "U"-shaped frame. As can be seen, the "U"-shaped frame is integrally formed as a single piece, thereby precluding the need for welding, fitting, cutting and abutting transverse support members. In turn, the cost of manufacture is substantially reduced because the frame 12 may be formed by taking a single tubular member and bending it to the shape illustrated in FIG. 6.

As better seen in FIG. 6, journal brackets 150 and 152 are shown to receive the drive roller 28. Rear foot structure 66 is also shown which may be added at the option of the user to provide additional transverse support for the left and right extensions 13 and 14 proximate the rear ends 20 and 24.

A left belt guide 154 and right belt guide 156 are also shown in FIG. 6. The endless belt 60 and more particularly the lower stretch 64 has a left edge 158 and right edge 160. The left guide 154 and the right guide 156 are each welded or otherwise secured to the underside of their respective left extension 13 and right extension 14.

The left guide 154 has a transverse member 162 welded to the underside of the left extension 13. The transverse member 162 extends inwardly toward the right extension 14 and is preferably normal, or substantially normal (e.g., +5°) to the left extension 13. Similarly, the right guide 156 has a transverse member 164 which extends inwardly toward the left extension 13. The transverse member 164 is welded to the underside of the right extension 14 and preferably extends inwardly substantially normal to the right extension 14.

A left finger 166 is secured to the end 167 of the left extension 162. Similarly, a right finger 168 is secured to the end 169 of the right transverse extension 164. The left finger 166 and the right finger 168 are oriented to extend upwardly, forwardly and inwardly as illustrated. More particularly, the left finger 166 is shown extending inwardly at an angle 170 of about 20° with respect to the left extension 13. The right finger 168 is similarly angled in a forward direction. The angle 170 may vary from about 10° to about 30°.

The right extension 168 is shown angled upwardly in FIG. 7 with respect to the transverse member 164 at an angle 172 which is here shown to be about 66° but may be from about 50° to about 75°. The left finger 166 is similarly angled upwardly. In FIG. 8, it can be seen that the right guide 156 and more particularly the right finger 168 is angled forwardly with respect to the transverse member 164 or the flat underside surface 174 of the right extension 14 at an angle 176 of about 30°. The finger 168 may be at an angle from about 20° to about 40°.

It has been found empirically that the left finger 166 and right finger 168 are best positioned inwardly at an angle 170 of about 20°; upwardly at an angle 172 of about 66° and forwardly at an angle 176 of about 30°. Such a position results in reduced noise from the belt 60 as well as reduced wear on the belt 60.

In operation, it can be best seen in FIG. 7 that the edge 158 or the edge 160 of the endless belt 60 and more particularly the lower stretch 64 may move along the finger 166 down to the connection between the transverse extensions 162 and 164 and their respective fingers 166 and 168. The left connection 178 and the right connection 180 (FIG. 7) are preferably rounded or smooth so that the belt edges 158 and 160 may move smoothly thereabout. It has been found in operation that as a belt edge 162 starts to move downwardly along the fingers 168 or 166, an increased force is urged upon the belt edge 162 by the fingers 166, thereby urging the belt edge 162 back into central alignment on the drive roller 28 and the tail roller 54. In such a configuration the drive roller 28 and the tail roller 54 may be a cylindrical configuration found in some treadmills.

It may be noted that the treadmill 10 of FIG. 1 with the left roller bracket 50 and right roller bracket 52 and its associated tail roller 54 facilitates construction of a treadmill by eliminating the need for one or more transverse cross-members secured between the left extension 13 and the right extension 14. A simple frame in the shape of a "U" may be readily formed by bending a single member. The economies of manufacture with the additional benefits of increased strength and lower material cost may be realized.

It may be understood that the above-described embodiments are not intended to limit the scope of the claims which themselves recite those features which are regarded as essential to the invention.

What is claimed:

1. A rear roller assembly for an exercise treadmill with an endless belt having parallel elongated left and right tubular frame members with spaced apart free ends, said roller assembly comprising:

a left and a right end cap each having a plug portion sized to fit snugly within the distal ends of said left tubular frame member and said right tubular frame member, respectively;

left and right bearing slots formed in said left and said right end caps respectively;

an elongated roller member having one end rotatably secured in and between said left and right bearing slots, the length of said roller being selected to space said left and said right end caps and to receive and support the endless belt about said elongated roller; and left adjusting means and right adjusting means adapted to said left and right end caps, respectively, each for adjusting the position of said left and said right bearing blocks in relation to said end caps respectively.

* * * * *